US005829457A

United States Patent [19]

Huang

[11] Patent Number: 5,829,457

[45] Date of Patent: Nov. 3, 1998

[54] HAIR CLIP AND MANUFACTURING METHOD THEREFOR

[76] Inventor: Chun-Fu Huang, No. 14, Alley 52, Lane 671, Chang-See Rd., Sec. 2, Tainan, Taiwan

[21] Appl. No.: 880,289

[22] Filed: Jun. 24, 1997

[51] Int. Cl.[6] ..... A45D 8/14

[52] U.S. Cl. ..... 132/275; 63/3

[58] Field of Search ..... 132/273, 275; 2/174, 209.13, 209.14, DIG. 11; 63/1.16, 1.17, 3, 11, 40, 43; D28/33, 41

[56] References Cited

U.S. PATENT DOCUMENTS

| | | | |
|---|---|---|---|
| 248,542 | 10/1881 | Wilson | 132/275 |
| 1,715,331 | 5/1929 | Richter | 132/275 |
| 4,581,271 | 4/1986 | Gordon | 63/3 |
| 4,999,747 | 3/1991 | Chen | 63/3 |
| 5,027,992 | 7/1991 | Murray, III | 2/DIG. 11 |
| 5,427,123 | 6/1995 | Odenthal | 132/275 |

FOREIGN PATENT DOCUMENTS

| | | | |
|---|---|---|---|
| 399681 | 7/1909 | France | 132/275 |
| 1217287 | 5/1960 | France | 132/275 |

*Primary Examiner*—Todd E. Manahan
*Attorney, Agent, or Firm*—Rosenberg, Klein & Bilker

[57] ABSTRACT

A hair clip includes an arcuate main body having a recess defined in a side thereof and an arcuate decorative piece securely mounted in the recess. A bottom wall which defines the recess includes two slots defined in each of two ends thereof. The decorative piece has two hooks respectively formed on two ends of a first side thereof and a pattern formed on a second side thereof. The hooks extend through the associated slots and respectively, securely engage with two ends of the bottom wall defining the recess.

2 Claims, 6 Drawing Sheets

HAIR CLIP AND MANUFACTURING METHOD THEREFOR

BACKGROUND OF THE INVENTION

1. Field of the Invention

The present invention relates to an improved hair clip structure which provides more decorative choices for users. The present invention also relates to a method for manufacturing the hair clip.

2. Description of the Related Art

Hair clips are commonly used by female to fix the hair and to achieve an aesthetic purpose. The users may buy hair clips of different patterns and shapes to suit their customs and hair styles. FIG. 7 of the drawings illustrates a typical conventional hair clip 50 in which the manufacturers have to design various molds to produce various patterns on the hair clip 50, which,results in a high cost for the various molds. The present invention is intended to provide an improved hair clip which mitigates and/or obviates the above problems.

SUMMARY OF THE INVENTION

A hair clip in accordance with the present invention comprises an arcuate main body having a recess defined in a side thereof and an arcuate decorative piece securely mounted in the recess. A bottom wall which defines the recess includes two slots defined in each of two ends thereof. The decorative piece has two hooks respectively formed on two ends of a first side thereof and a pattern formed on a second side thereof. The hooks extend through the associated slots and respectively, securely engage with two ends of the bottom wall defining the recess.

The present invention also provides a method for manufacturing a hair clip which comprises the steps of:

(a) providing a flat main body having a recess defined in a side thereof, a bottom wall which defines the recess including two slots defined in each of two ends thereof, (b) placing a flat decorative piece in the recess, the decorative piece having two hooks respectively formed on two ends of a first side thereof and a pattern formed on a second side thereof, each hook extending through an associated slot, and (c) heating and bending the flat main body and the flat decorative piece such that the hooks move toward each other and respectively, securely engage with two ends of the bottom wall defining the recess.

By such an arrangement, the manufacturers may save cost in the molds for the main bodies of the hair clips and provide more choices for users.

Other objects, advantages, and novel features of the invention will become more apparent from the following detailed description when taken in conjunction with the accompanying drawings.

DESCRIPTION OF THE PREFERRED EMBODIMENT

Figure 1:
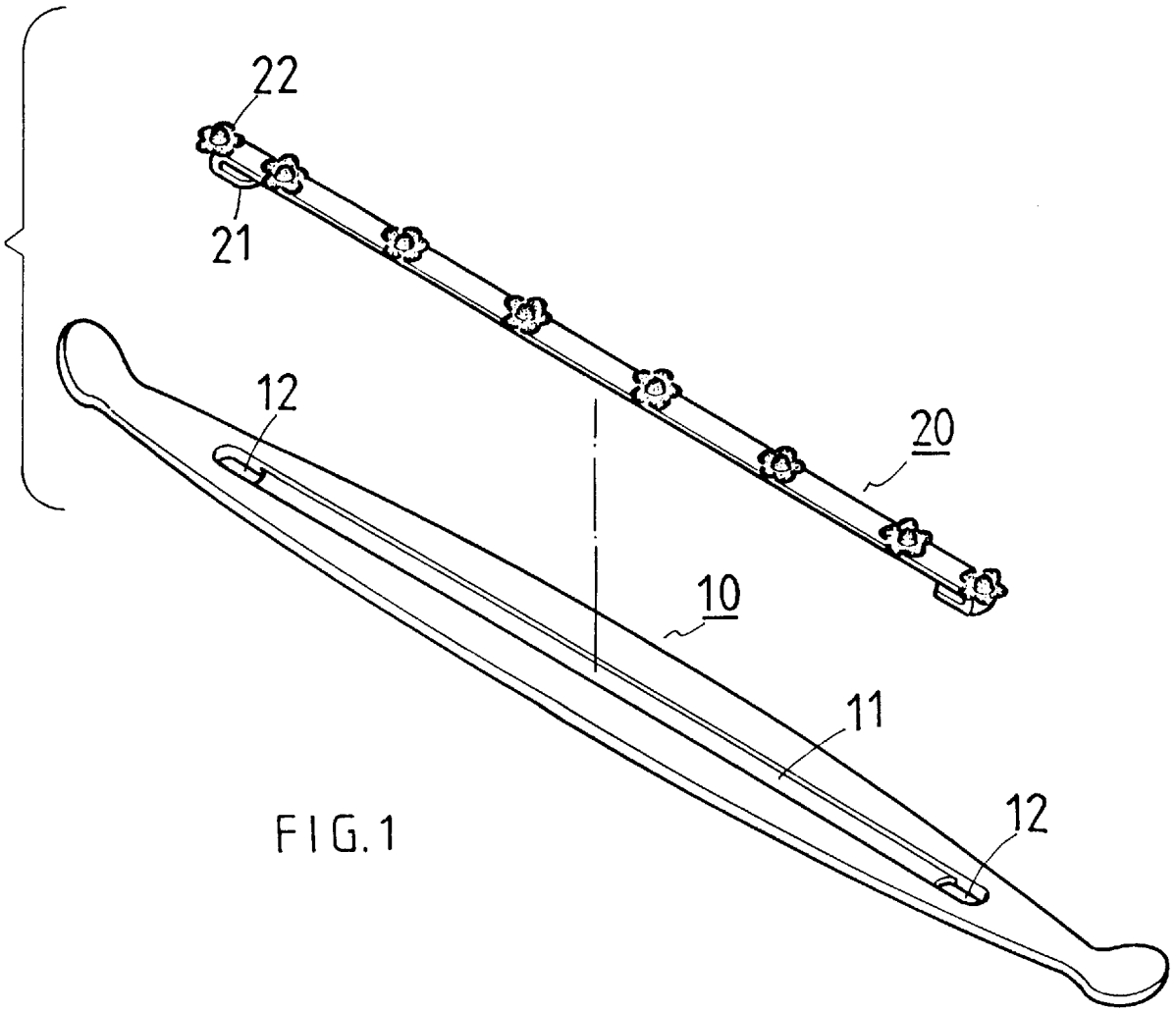
FIG. 1 is an exploded perspective view of a hair clip in accordance with the present invention before formation.
Figure 2:
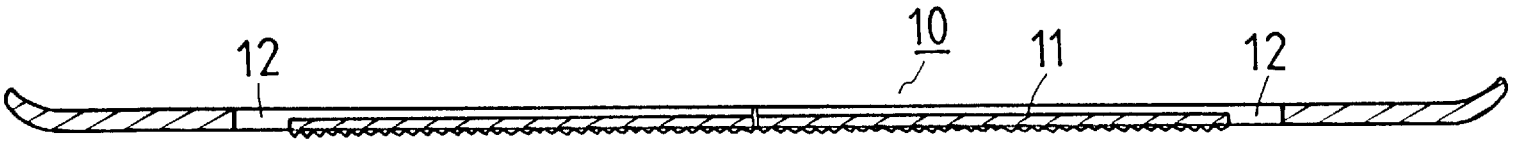
FIG. 2 is a sectional view of a main body of the hair clip in accordance with the present invention before formation.
Figure 3A:
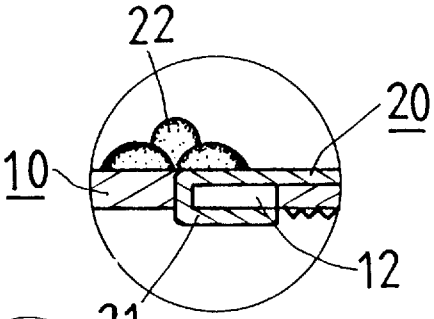
FIG. 3A is an enlarged view of a circle in FIG. 3.
Figure 3:
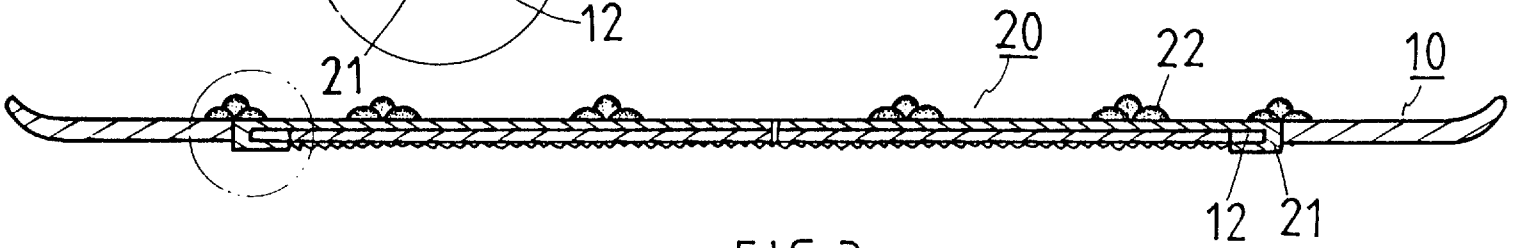
FIG. 3 is a sectional view of the hair clip in accordance with the present invention before formation.
Figure 4:
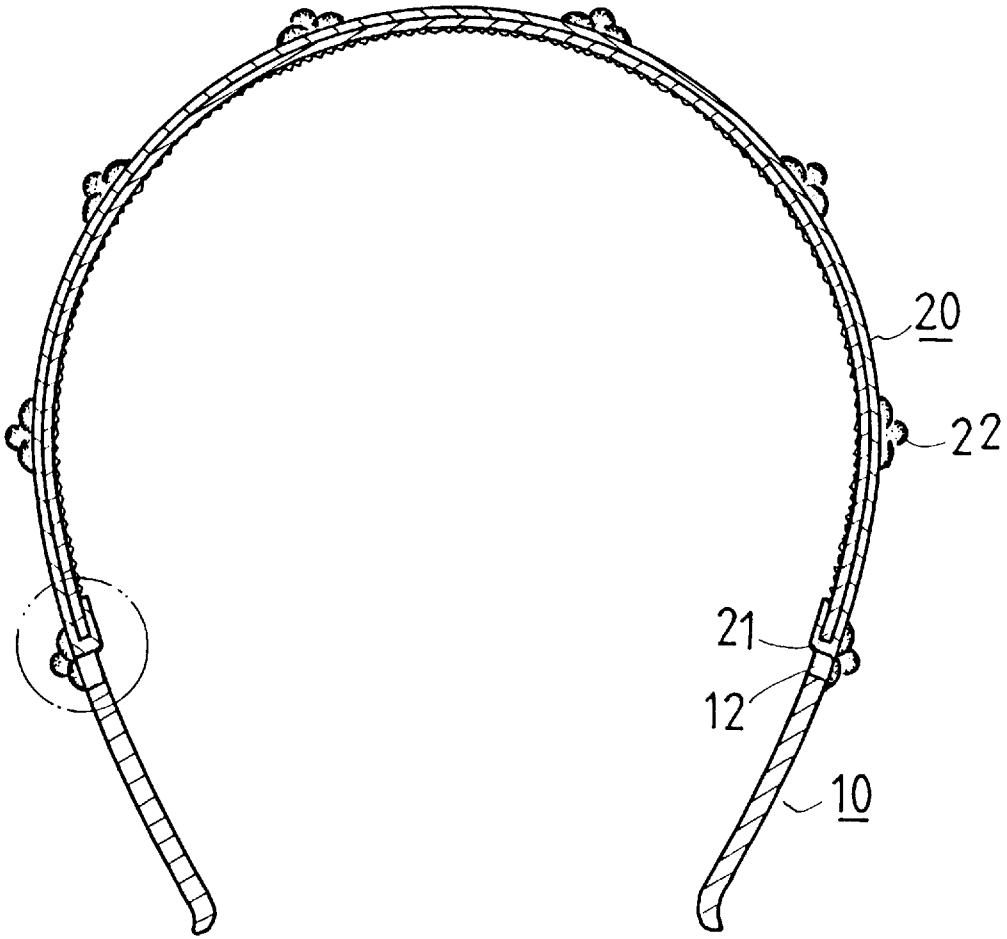
FIG. 4 is a sectional view of the hair clip in accordance with the present invention.
Figure 5:
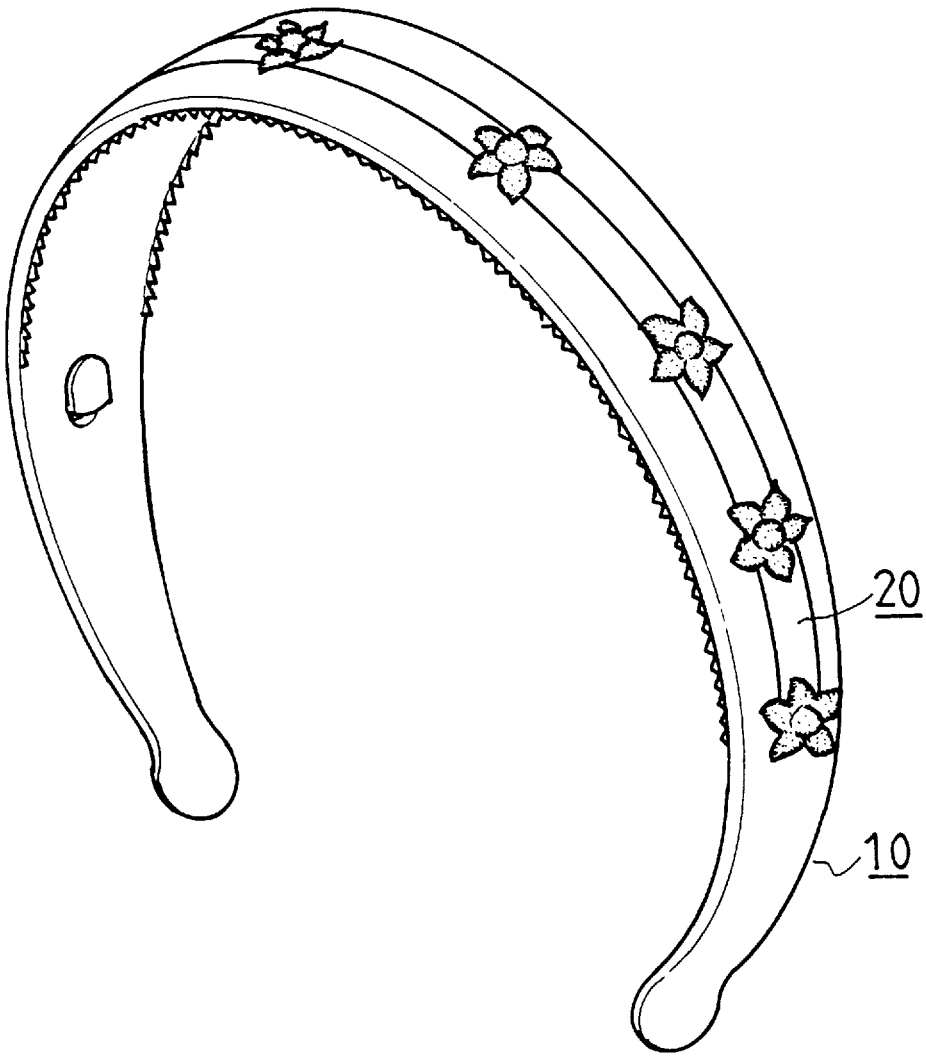
FIG. 5 is a perspective view of the hair clip in accordance with the present invention.

Referring to FIGS. 1 to 6 and initially to FIGS. 4 and 5, a hair clip in accordance with the present invention generally comprises an arcuate main body 10 having an arcuate decorative piece 20 mounted thereon. Referring to FIG. 1, the main body 10 may be formed by a flat main body 10 having a recess 11 defined in a side thereof, and an slot 12 is defined in each of two ends of a bottom wall defining the recess 11. The decorative piece 20 is formed by a flat decorative piece 20 having a hook 21 provided on each of two ends of a first side thereof and a desired pattern (e.g., a number of decorative elements 22) on a second side thereof.

Figure 4A:
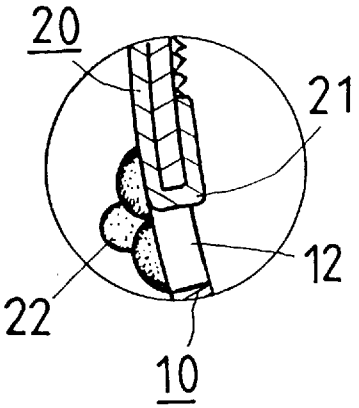
FIG. 4A is an enlarged view of a circle in FIG. 4.

Referring to FIGS. 2, 3, and 3A, the flat decorative piece 20 is received in the recess 11 with the hooks 21 extend through the slots 12. The flat decorative piece 20 and the flat main body 10 are then heated and bent to form the hair clip shown in FIGS. 4, 4A, and 5. It is appreciated that the hooks 21 have open ends facing each other such that the hooks 21 move toward each other during the heating and bending process so as to respectively, securely engage two ends of the bottom wall defining the recess 11, as shown in FIG. 4A.

Figure 6:
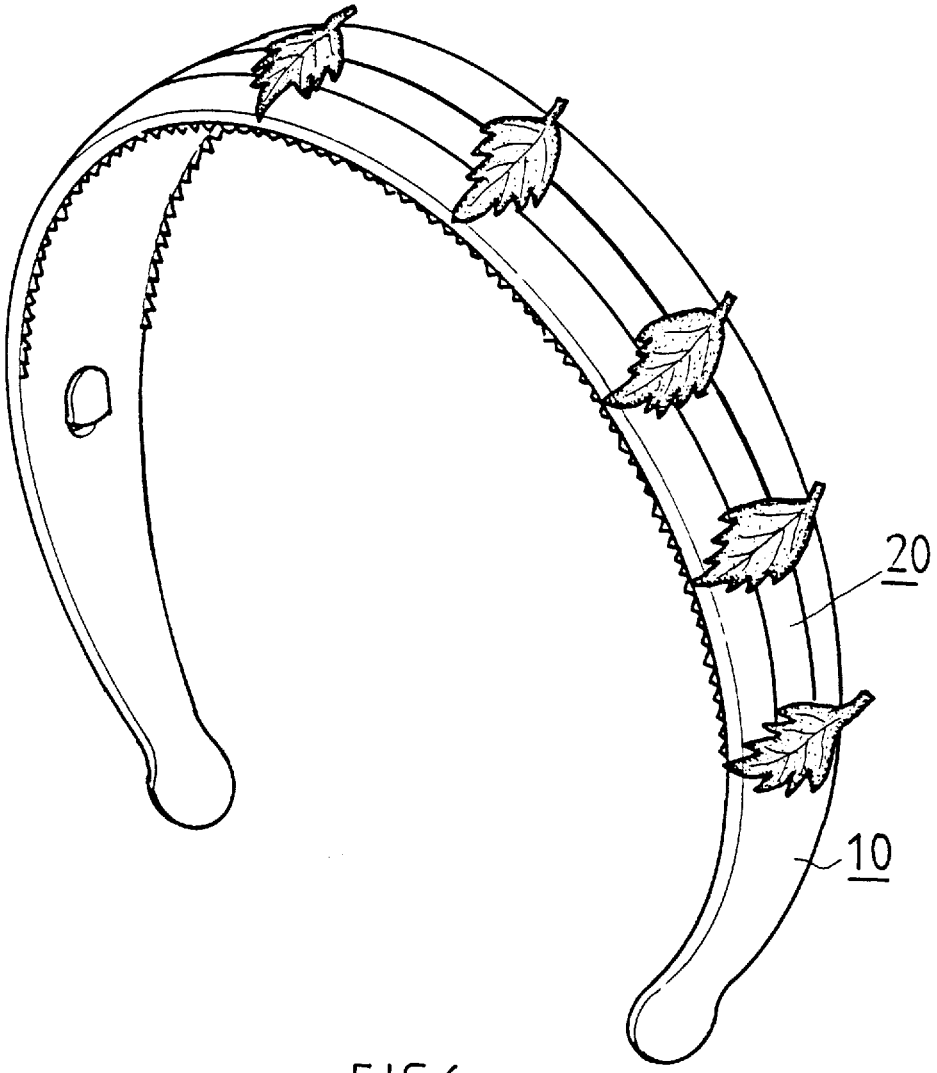
FIG. 6 is a perspective view of a modified embodiment of the hair clip in accordance with the present invention.
Figure 7:
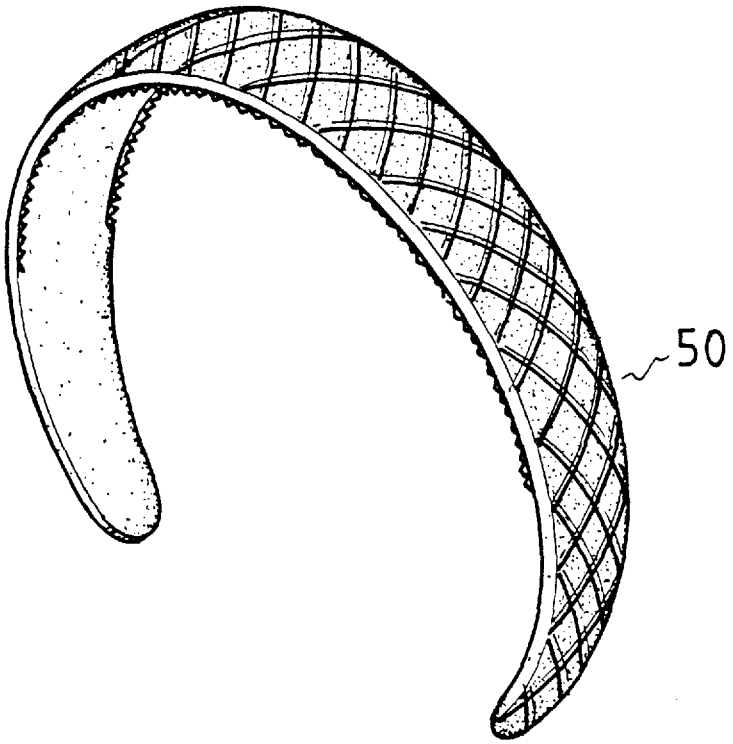
FIG. 7 PRIOR ART
FIG. 7 is a perspective view of a hair clip according to prior art.

FIG. 5 shows a final product of the hair clip. FIG. 6 illustrates a modified embodiment of the hair clip having a different pattern on the decorative piece 20. By such an arrangement, it is appreciated that the manufacturers may save cost in the molds of the main body, and the resultant hair clips may have different patterns by means of changing the decorative pieces during manufacture. The decorative piece may be securely positioned in the main body by the hooks. In addition, the decorative patterns are three-dimensional which is good looking and may appeal the users.

Although the invention has been explained in relation to its preferred embodiment, it is to be understood that many other possible modifications and variations can be made without departing from the spirit and scope of the invention as hereinafter claimed.

What is claimed is:

1. A hair clip, comprising:

an arcuate decorative member having a decorative surface and a pair of hooking members formed at opposing ends thereof, each said hooking member including an engaging recess;

an arcuate main body member having an arcuate recess formed therein for receiving said arcuate decorative member, said arcuate recess defining an arcuate bottom wall extending between a pair of slots formed through said arcuate main body, each said slot receiving a respective one of said hooking members, whereby each said engaging recess engages a respective adjacent end portion of said bottom wall for securing said arcuate decorative member to said arcuate main body member.

2. A method for manufacturing a hair clip, comprising the steps of:

providing a substantially planar decorative member having a decorative surface and a pair of hooking members formed at opposing ends thereof, each said hooking member including an engaging recess;

providing a substantially planar main body member having a recess formed therein for receiving said decorative member, said recess defining a bottom wall extending between a pair of slots formed through said main body member;

receiving said decorative member in said recess of said main body member with said decorative surface exposed, and with each slot receiving a respective one of said hooking members therethrough;

heating and forming said main body member and said decorative member, whereby said hooking members are displaced toward one another and each said engaging recess is correspondingly displaced to securely engage a respective adjacent end portion of said bottom wall for securing said decorative member to said main body member.

* * * * *